US006131889A

United States Patent [19]

Birdsell et al.

[11] Patent Number: 6,131,889

[45] Date of Patent: Oct. 17, 2000

[54] EVAPORATIVE HUMIDIFIER WITH LIQUID DISTRIBUTION SYSTEM

[75] Inventors: Walter Birdsell, Marlborough; John Longan, Shrewsbury, both of Mass.

[73] Assignee: Honeywell, Inc., Minneapolis, Minn.

[21] Appl. No.: 09/216,453

[22] Filed: Dec. 18, 1998

[51] Int. Cl.[7] ..... B01F 3/04

[52] U.S. Cl. ..... 261/29; 261/91; 261/106

[58] Field of Search ..... 261/29, 36.1, 94, 261/97, 98, 100, 103, 106, 85, 88, 91, DIG. 41

[56] References Cited

U.S. PATENT DOCUMENTS

| | | | |
|---|---|---|---|
| 2,281,799 | 5/1942 | Quave | 261/106 |
| 2,527,015 | 10/1950 | Lhota | 261/106 |
| 2,639,905 | 5/1953 | Dow | 261/106 |
| 3,220,707 | 11/1965 | Weatherston et al. | 261/29 |
| 3,348,821 | 10/1967 | Martin et al. | 261/29 |
| 3,348,822 | 10/1967 | Vieceli et al. | 261/106 |
| 3,914,349 | 10/1975 | Stipanuk | 261/29 |
| 4,269,573 | 5/1981 | Goode | 261/29 |
| 4,301,094 | 11/1981 | Baus | 261/29 |
| 4,350,646 | 9/1982 | Baus | 261/106 |
| 5,490,957 | 2/1996 | Lasko et al. | 261/106 |
| 5,783,117 | 7/1998 | Byassee et al. | 261/29 |

FOREIGN PATENT DOCUMENTS

| | | | |
|---|---|---|---|
| 55-126754 | 9/1980 | Japan | 261/29 |

*Primary Examiner*—C. Scott Bushey

*Attorney, Agent, or Firm*—John E. Toupal; Harold G. Jarcho

[57] ABSTRACT

An evaporative humidifier including a portable housing defining an air inlet, an air outlet, an air flow path between the inlet and the outlet, and a liquid reservoir; a blower system including a fan blade for producing air flow through the path between the inlet and the outlet; and a liquid absorbent evaporator pad disposed above the reservoir and in the path between the inlet and the outlet; the pad being a hollow cylinder and having a top surface, a bottom surface, and radially spaced apart cylindrical and coaxial inner and outer surfaces; and wherein the air flow path includes an axial section at least partially defined by the inner surface, and a transverse section communicating with the outer surface. Also included is a liquid distribution system for circulating liquid from the reservoir to the top surface of the pad and having a conical centrifugal pump extending co-axially through the hollow cylinder and defining a lower orifice disposed in the reservoir and an upper orifice disposed above the top surface; and passage means providing liquid communication between the vessel and a chamber enclosing the upper orifice; and an electric motor having a shaft rotatably coupled to the cone member and the fan blade.

8 Claims, 8 Drawing Sheets

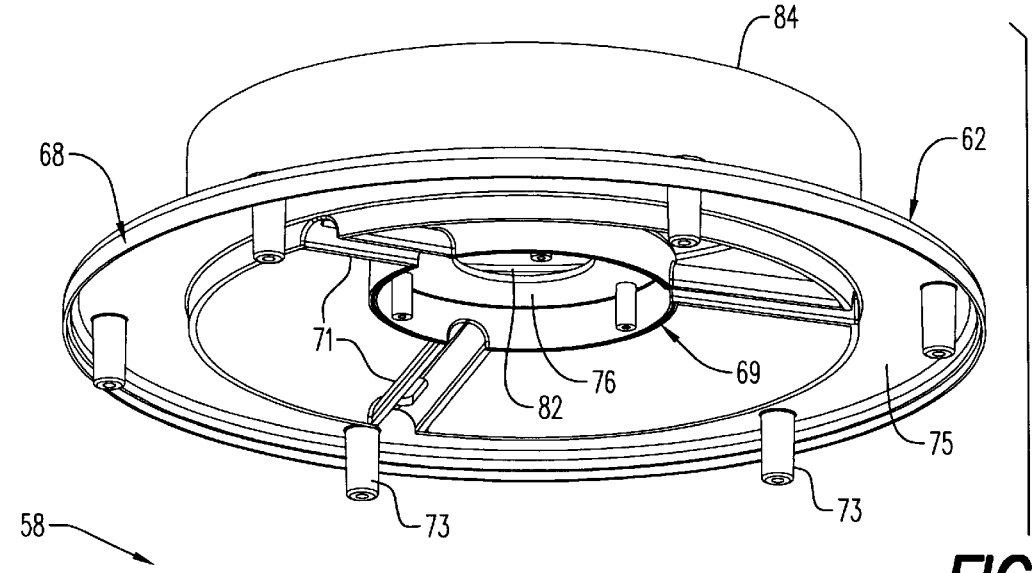
FIG. 7
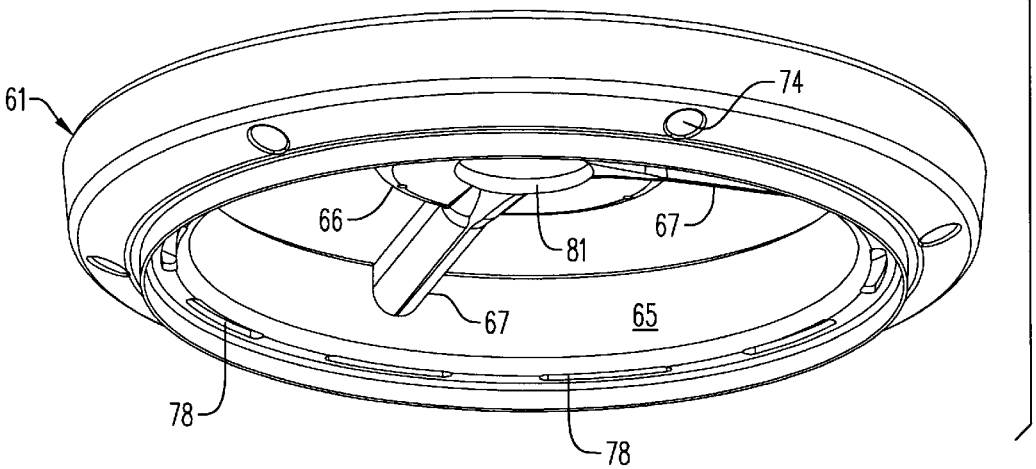

EVAPORATIVE HUMIDIFIER WITH LIQUID DISTRIBUTION SYSTEM

BACKGROUND OF THE INVENTION

The invention relates generally to an evaporative humidifier device, and, more particularly, to an evaporator device utilizing a liquid absorbing element to provide humidification.

Evaporator devices are used extensively to enhance personal comfort by increasing the level of humidity in an enclosed environment. They can function additionally to provide cooling in many hot, dry regions. One well known type of evaporative humidifier employs absorbing wick elements that produce by capillary action liquid flow from a reservoir to wick portions disposed in a path of airflow provided by an electrical blower. One deficiency of wick type evaporators results from the inability of wick elements to draw liquid beyond a maximum height of about six inches. Because of this factor, the effective airflow output of wick type evaporators in cubic feet per minute (CFM) has been limited. An improved evaporative humidifier is disclosed in U.S. Pat. No. 5,162,088. That device employs a liquid pump to circulate water from a reservoir onto evaporative elements positioned above the reservoir. Although increasing output, the disclosed humidifier is less than fully satisfactory because of various factors such as high cost and inefficient liquid distribution.

The object of this invention, therefore, is to provide an improved evaporative humidifier exhibiting increased airflow output.

SUMMARY OF THE INVENTION

The invention is an evaporative humidifier including a portable housing defining an air inlet, an air outlet, an air flow path between the inlet and outlet, and a liquid reservoir; a blower system for producing air flow through the path between the inlet and outlet; and a liquid absorbent evaporator pad disposed in the path between the inlet and outlet; the pad having an upper surface, a lower surface, and side surfaces extending between the upper and lower surfaces. Also included is a liquid distribution system for circulating liquid from the reservoir to the upper surface of the pad. The distribution system saturates the pad with moisture which is collected and dispensed by air flowing in the air flow path.

According to one feature of the invention, the liquid distribution system includes a vessel disposed above the evaporator pad and defining openings providing liquid communication between the vessel and the upper surface. Water received from the reservoir by the vessel is discharged through the openings to saturate the evaporator pad.

According to another feature of the invention, the pad is a hollow cylinder having a top surface defining the upper surface, a bottom surface defining the lower surface, and radially spaced apart cylindrical and coaxial inner and outer surfaces defining the side surfaces. The hollow cylindrical evaporator pad provides efficient moisture transfer surfaces.

According to yet another feature of the invention, the vessel is annular and substantially vertically aligned with the top surface, and the openings are substantially uniformly distributed over substantially the entire top surface. These features facilitate desired complete water saturation of the evaporator pad.

According to still another feature of the invention, the air flow path includes an axial path section at least partially defined by the inner surface, and a transverse path section communicating with the outer surface. The transverse and axial air flow paths through the cylindrical evaporator pad provides highly efficient moisture transfer to circulating air.

According to further features of the invention, the distribution system includes a centrifugal pump in the form of an inverted, hollow cone member extending co-axially through the hollow cylinder and defining a lower orifice disposed in the reservoir and an upper orifice disposed above the top surface; a closed chamber enclosing the upper orifice; and a passage mechanism providing liquid communication between the vessel and the chamber. These features effectively provide desired water circulation from the reservoir to the evaporator pad.

According to additional features, the invention includes an electric motor having a shaft rotatably coupled to the cone member; and the blower system includes a fan blade rotatably coupled to the shaft. The single motor functions to provide the humidifier with both air flow and water circulation.

According to yet another feature, the invention includes a catch basin disposed below the lower surface of the pad and communicating with the reservoir. The catch basin is positioned to receive liquid falling from the pad for efficient recirculation by the distribution system.

DESCRIPTION OF THE DRAWINGS

These and other objects and features of the invention will become more apparent upon a perusal of the following description taken in conjunction with the accompanying drawings wherein:

FIG. 7 is an exploded perspective view of a portion of the water distribution system shown in FIG. 3;

DESCRIPTION OF THE PREFERRED EMBODIMENT

Figure 1:
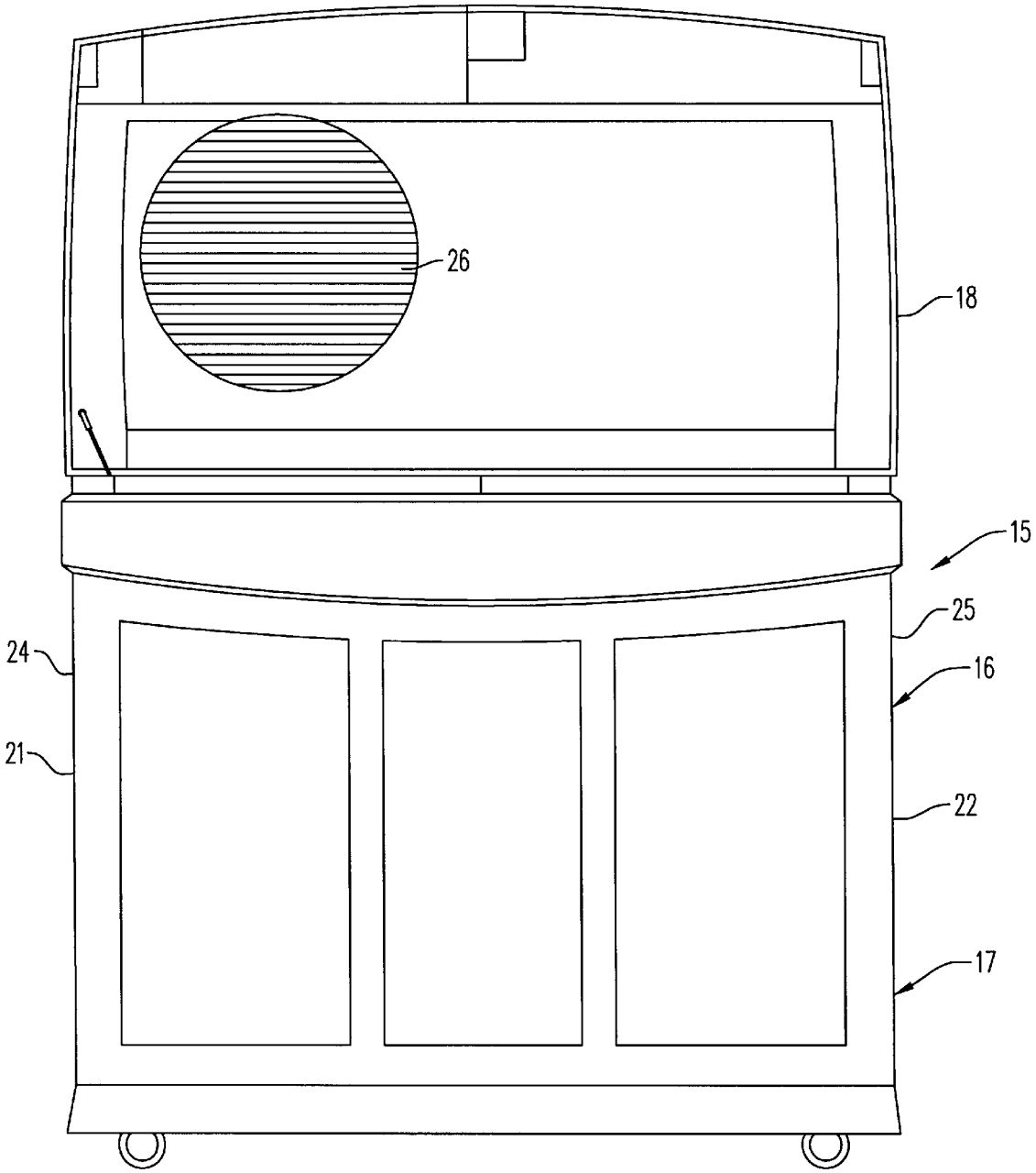
FIG. 1 is a front elevational view of a portable evaporative humidifier according to the invention.
Figure 2:
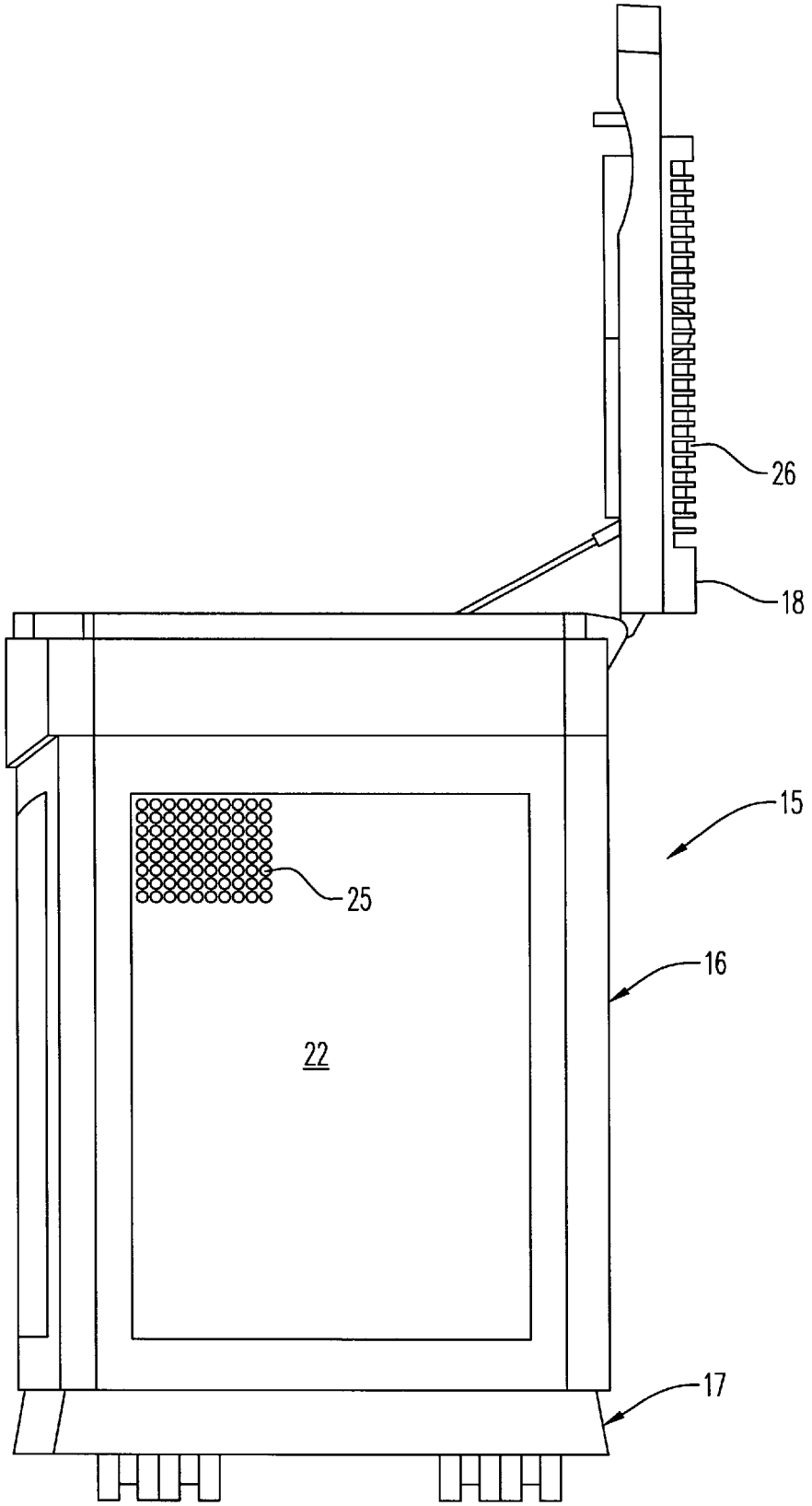
FIG. 2 is a side elevational view of the humidifier.

An evaporative humidifier 15 includes a housing 16 formed by a portable base unit 17 and a hinged cover 18 illustrated in FIGS. 1 and 2. Defined by side walls 21, 22 of the housing 16 are, respectively, air inlets 24, 25. Another inlet 20 is formed in a rear wall of the housing 16 while an air outlet 26 is formed in the cover 18. Also defined by the housing 16 is an air flow path 28 between the inlets 20, 24, and 25 and the outlet 26 and described in greater detail hereinafter.

Figure 3:
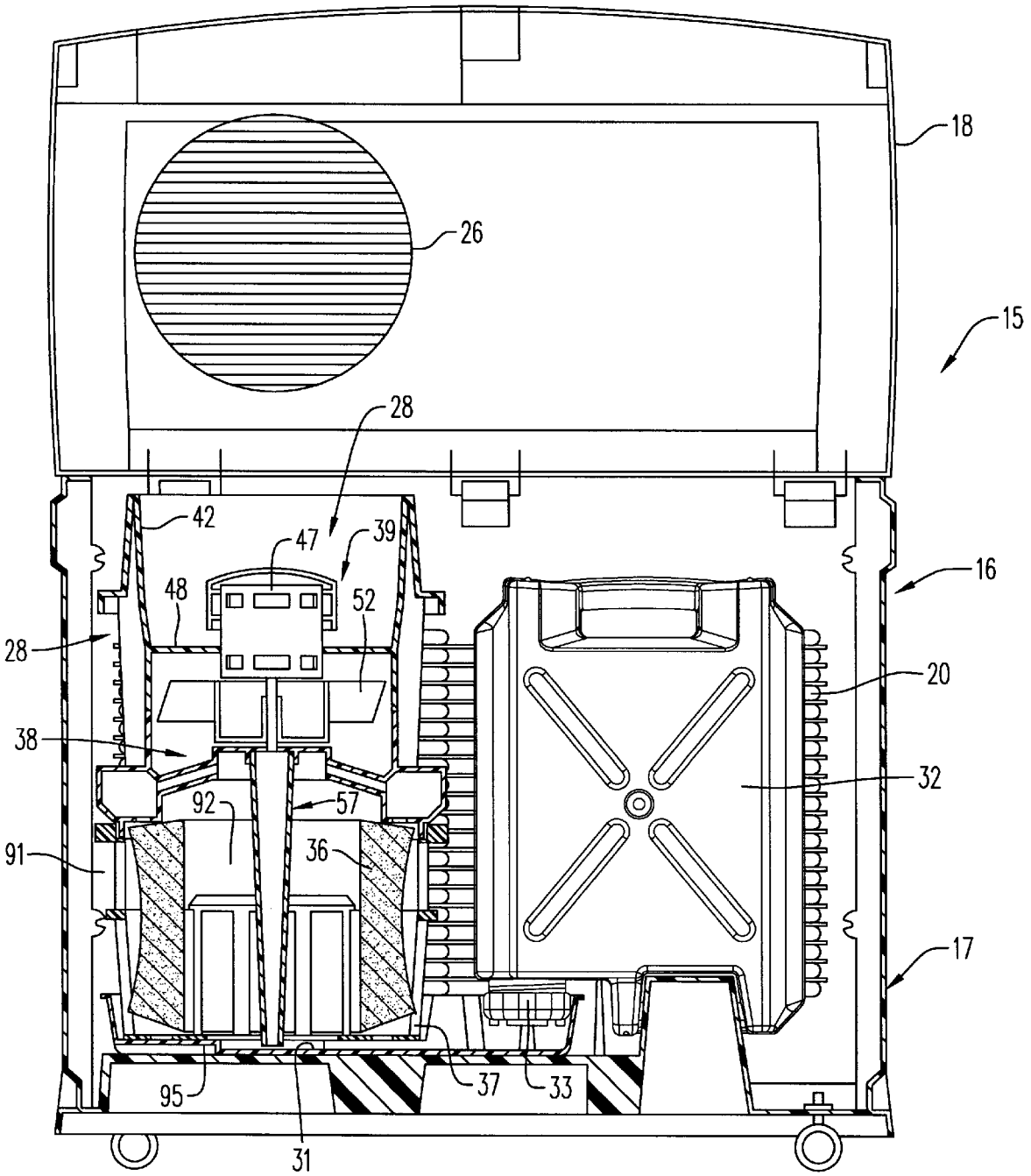
FIG. 3 is a cross-sectional view of the humidifier shown in FIGS. 1 and 2.
Figure 4:
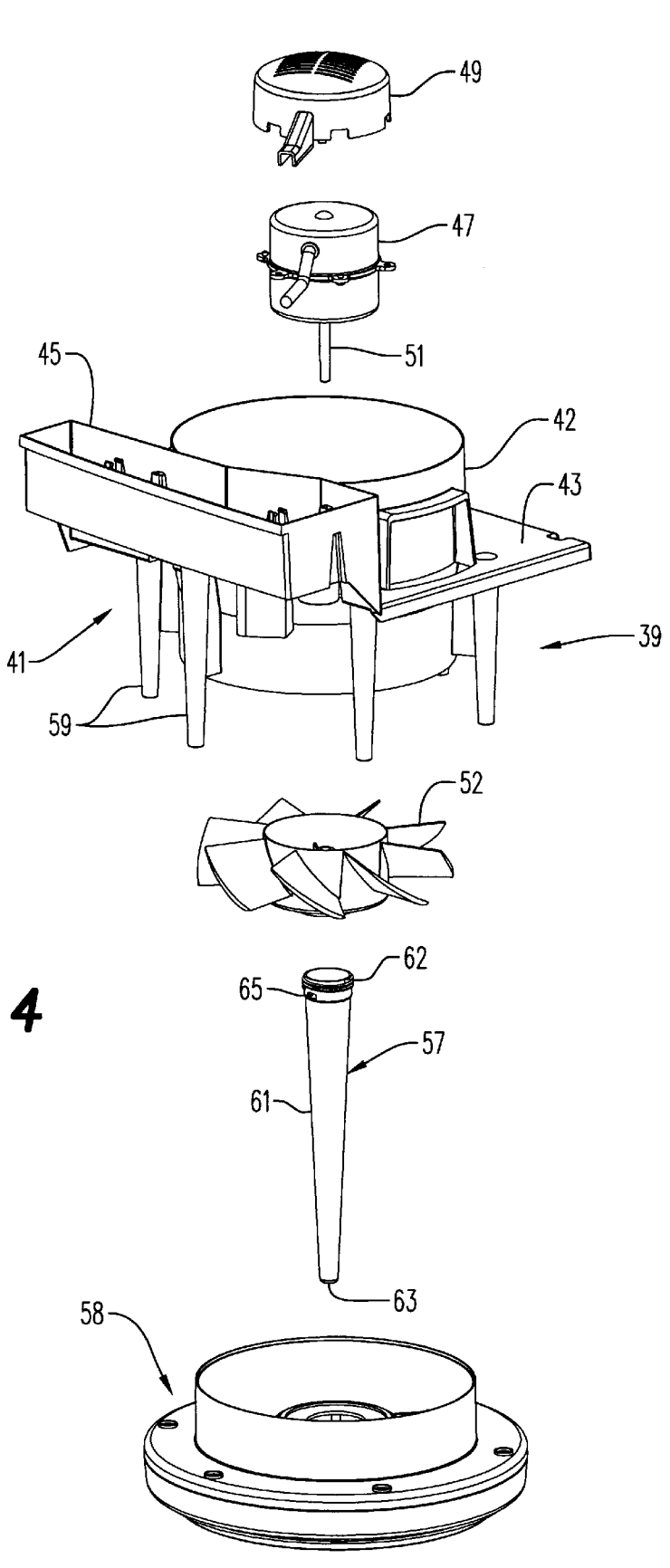
FIG. 4 is an exploded view of an air blower and water distribution system of the humidifier shown in FIG. 3.

As shown in FIG. 3, a bottom portion of the base unit 17 defines a reservoir 31 and supports a liquid supply tank 32 which maintains a given liquid level therein. A bottom wall portion of the supply tank 32 defines a water fill opening closed by a cap 33 which retains a valve (not shown) providing a controlled liquid flow from the tank 32 to the reservoir 31. The cap and valve structure 33 is conventional and can be, for example, of the type shown in U.S. Pat. No. 5,483,616. Also, mounted in the base unit 17 above the reservoir 31 is a liquid absorbent evaporator pad 36, a retainer receptacle 37 for the evaporator pad 36, and a liquid distribution system 38 for circulating water from the reservoir 31 to the evaporator pad 36 as described below. An air blower system 39 can be energized to produce air flow through the air flow path 28 between the inlets 20, 24, and 25 and the outlet 26.

Figure 5:
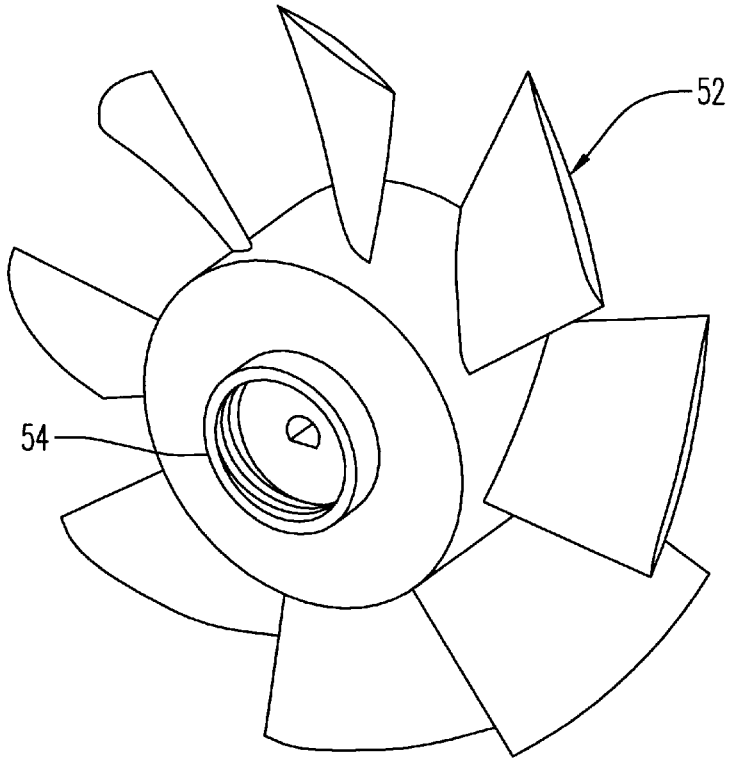
FIG. 5 is a perspective view of a fan blade used in the air blower system of FIG. 3.

The liquid distribution and blower systems 38, 39 are shown in greater detail in FIGS. 4–8. Supporting the systems 38, 39 in the housing 16 is a mounting unit 41 (FIG. 4) having a hollow tubular portion 42 and transversely extending, supporting flange portion 43. Also supported by the flange portion 43 is a case 45 for conventional electrical controls (not shown). The blower system 39 includes an electric motor 47 mounted on a shoulder flange projecting inwardly from the tubular portion 42. Projecting from a lower end of the motor 47 is a rotatable output shaft 51 while an upper end is covered by a motor cap 49. A fan blade 52 is rotatably coupled to the output shaft 51. As shown in FIG. 5, an internally threaded sleeve 54 projects axially from the bottom of the fan blade 52.

The water distribution system 38 includes an inverted centrifugal pump element 57 engaged with the threaded sleeve 54 of the fan blade 52 and an annular liquid distribution assembly 58 surrounding the pump element 57 and secured to the mounting unit 41 by a plurality of downwardly projecting posts 59.

Figure 6:
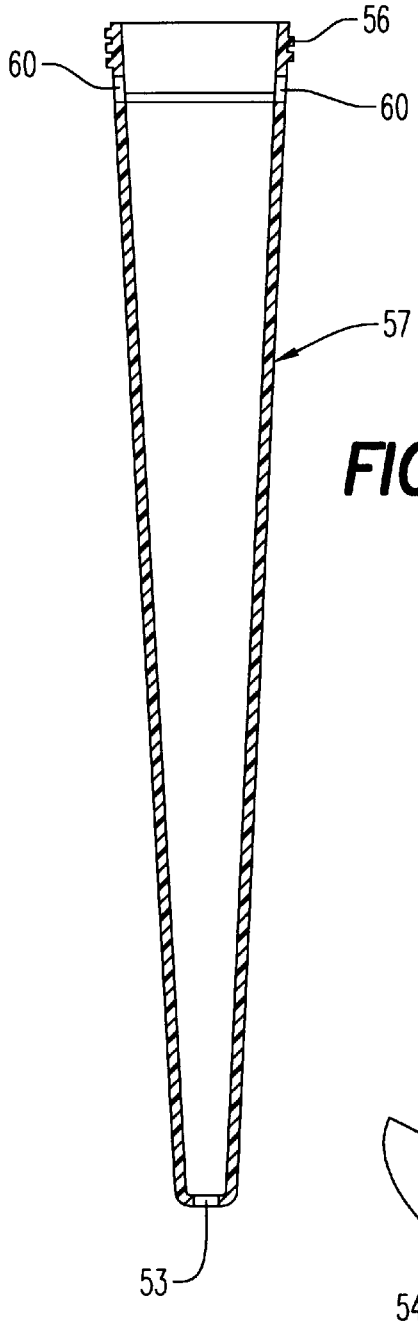
FIG. 6 is a pump element used in the water distribution system of FIG. 3.

As shown in FIG. 6, the pump element 57 is an inverted, hollow cone having an externally threaded upper end 56 for engaging the sleeve 54 of the fan blade 52 and a lower end defining an intake orifice 53. Also defined in an upper portion of the cone 57 below the threaded portion 56 are a pair of diametrically opposed discharge orifices 60. The intake orifice 53 is positioned in the reservoir 31 as shown in FIG. 3. In response to energization of the motor 47, the cone pump 57 rotates to produce centrifugal forces which draw liquid through the intake orifice 53 for discharge through the discharge orifices 60.

Figure 8:
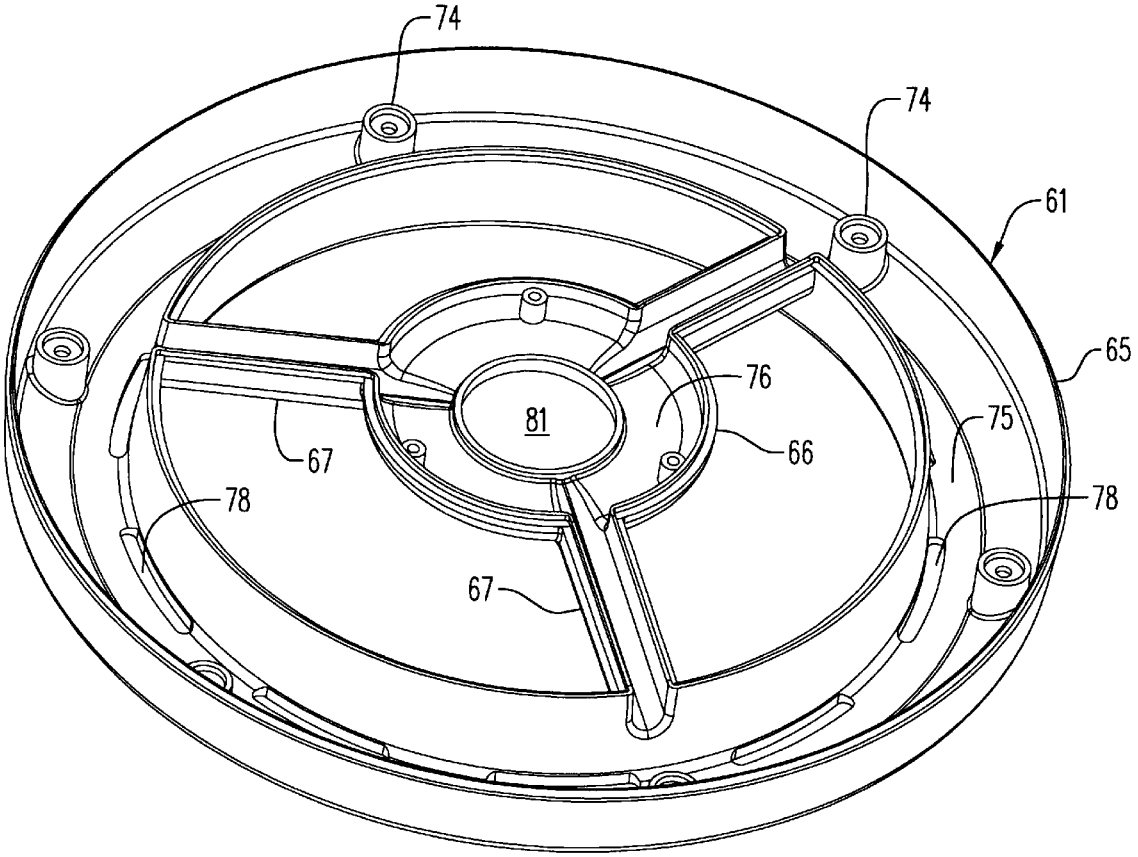
FIG. 8 is a top perspective view of a base portion of the distribution system shown in FIG. 7.

As shown in FIGS. 7 and 8, the liquid distribution assembly 58 is formed by a base member 61 and an engaged cover member 62. The base member 61 includes an annular, outer cup portion 65 and a coaxial, annular inner cup portion 66 joined by a plurality of radially extending, upwardly opening channel portions 67. Similarly, the cover member 62 includes an annular, inverted outer cup portion 68 and a coaxial, annular inverted inner cup member 69 joined by a plurality of radially projecting, downwardly opening channels 71. During assembly of the distribution unit 58, a plurality of studs 73 projecting downwardly from the outer cup portion 68 of the cover member 62 are received by ports 74 in the outer cup portion 65 of the base member 61. After assembly of the base and cover members 61, 62 the outer cup portions 65, 68 form an annular vessel 75, the inner cup portions 66, 69 form an annular, closed chamber 76, and the mated channels 67, 71 form a plurality of radially projecting tubes providing liquid communication between the closed chamber 76 and the annular vessel 75. A plurality of circumferentially spaced apart and uniformly distributed slotted openings 78 are formed in the lower surface of the outer cup portion 65 of the base member 61. Defined by the inner cup portions 66, 69 are, respectively, aligned central openings 81, 82 that accommodate passage of the conical pump 57 shown in FIG. 3. Also, a sleeve 84 projecting upwardly from the outer cup portion 68 of the cover member 62 is dimensioned for closely fitting over the tubular portion 42 of the mounting unit 41 as also shown in FIG. 3.

Figure 10:
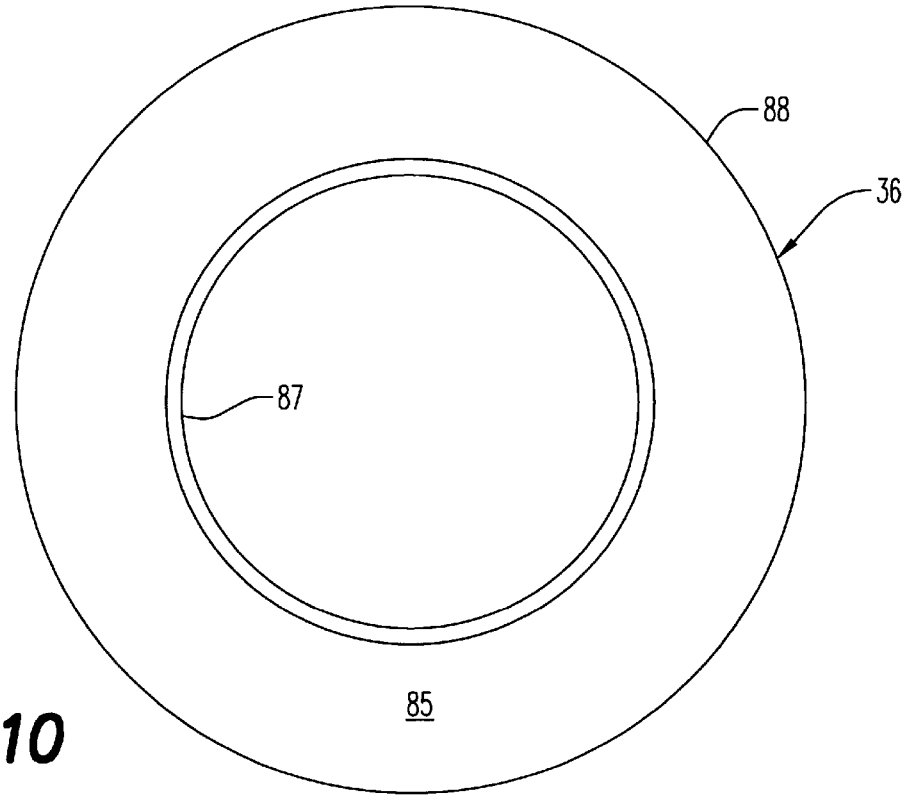
FIG. 10 is a top view of the evaporative pad shown in FIG. 9.
Figure 9:
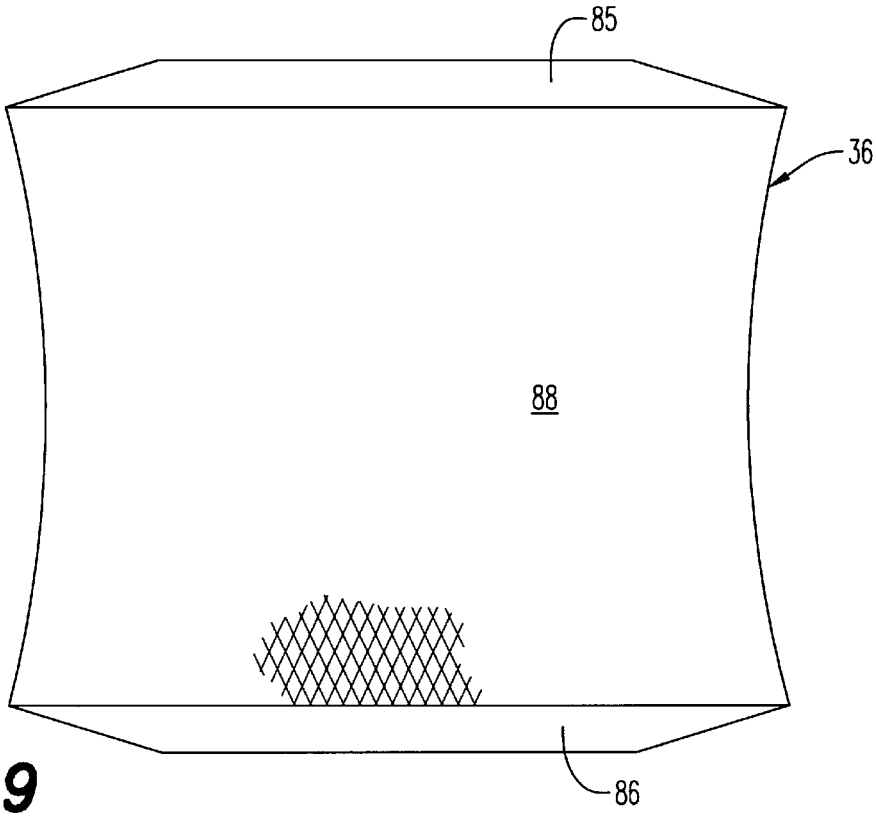
FIG. 9 is an elevational view of an evaporative pad used in the humidifier shown in FIGS. 1–3.

Referring now to FIGS. 9 and 10, the evaporator pad 36 is a hollow cylindrical element formed of a suitable water absorbent material typically used in evaporative humidifiers. The pad 36 has a tapered, annular top surface 85 and a tapered, annular bottom surface 86. Extending between inner and outer edges of the top and bottom surfaces 85, 86, are, respectively, a cylindrical, inner side surface 87 and a cylindrical, outer side surface 88. With the pad 36 positioned in the base unit 17 and within the retainer receptacle 37 (FIG. 3), the top surface 85 is vertically aligned with the annular vessel 75 formed by the liquid distribution assembly 58 and with the liquid openings 78 therein.

Upon energization of the motor 47, the fan blade 52 rotates to produce air flow in the air flow path 28 between the inlets 20, 24, 25 and the outlet 26. The airflow path 28 includes a transverse path section 91 defined between the housing 16 and the outer side surface 88 of the evaporator pad 36 and an axial path section 92 defined by the inner cylindrical side surface 87 of the evaporator pad 36, the upwardly projecting sleeve 84 on the distribution assembly 58 and the tubular portion 42 on the mounting unit 41. Thus, air is drawn in through the inlets 20, 24, and 25 and circulates through the transverse path section 91, the evaporator pad 36 and the axial path section 92 before being discharged into the surrounding environment through the outlet 26.

Simultaneous rotation of the conical pump 57 draws water out of the reservoir 31 through the intake orifice 53 for discharge through the upper orifices 56 into the closed chamber 76 of the distribution assembly 58. Water accumulated in the closed chamber 76 drains through the downwardly sloping, radial tubes 67, 71 into the annular vessel 75 and then through the openings 78 onto the upper surface 85 of the evaporator pad 36. The water flow is sufficient to saturate the evaporator pad 36 with moisture which is collected by the air flow circulating in the air flow path 28 and then discharged into the environment through the outlet 26. Excess water not collected by the air flow migrates down the pad 36 and drops from its lower surface 86 into a catch basin 95 formed in the base unit 17 and communicating with the reservoir 31.

Obviously, many modifications and variations of the present invention are possible in light of the above teachings. It is to be understood, therefore, that the invention can be practiced otherwise than as specifically described.

What is claimed is:

1. An evaporative humidifier comprising:

a portable housing defining an air inlet, an air outlet, an air flow path between said inlet and said outlet, and a liquid reservoir;

a blower system including a fan blade for producing air flow through said path between said inlet and said outlet;

a liquid absorbent evaporator pad disposed above said reservoir and in said path between said inlet and said outlet; said pad being a hollow cylinder having a top surface, a bottom surface, and radially spaced apart cylindrical and coaxial inner and outer surfaces; and wherein said air flow path includes an axial section at least partially defined by said inner surface, and a transverse section communicating with said outer surface;

a liquid distribution system for circulating liquid from said reservoir to said top surface of said pad; said liquid distribution system comprising a vessel for receiving liquid from said reservoir, disposed above said top surface, and defining openings providing liquid communication between said vessel and said top surface; a centrifugal pump having an inverted, hollow cone member extending co-axially through said hollow cylinder and defining a lower orifice disposed in said reservoir and an upper orifice disposed above said top surface; a chamber enclosing said upper orifice; and passage means providing liquid communication between said vessel and said chamber; and an electric motor having a shaft rotatably coupled to said cone member and said fan blade.

2. An evaporative humidifier according to claim 1 wherein said openings are substantially uniformly distributed over substantially the entire said top surface.

3. An evaporative humidifier according to claim 1 wherein said vessel is annular and substantially vertically aligned with said top surface.

4. An evaporative humidifier according to claim 3 wherein said openings are substantially uniformly distributed over substantially the entire said top surface.

5. An evaporative humidifier according to claim 3 wherein said openings are substantially uniformly distributed over substantially the entire said top surface.

6. An evaporative humidifier according to claim 1 wherein said passage means includes a plurality of radially projecting tubes extending between said chamber and said vessel.

7. An evaporative humidifier according to claim 5 including a catch basin disposed below said lower surface of said pad and communicating with said reservoir, said catch basin being positioned to receive liquid falling from said pad.

8. An evaporative humidifier according to claim 1 including a catch basin disposed below said lower surface of said pad and communicating with said reservoir, said catch basin being positioned to receive liquid falling from said pad.

* * * * *